US009609928B2

(12) United States Patent
Gerdes

(10) Patent No.: US 9,609,928 B2
(45) Date of Patent: Apr. 4, 2017

(54) CONCEALED CARRY PURSE

(71) Applicant: Samantha Larue Gerdes, Leander, TX (US)

(72) Inventor: Samantha Larue Gerdes, Leander, TX (US)

( * ) Notice: Subject to any disclaimer, the term of this patent is extended or adjusted under 35 U.S.C. 154(b) by 32 days.

(21) Appl. No.: 14/664,838

(22) Filed: Mar. 21, 2015

(65) Prior Publication Data

US 2016/0010948 A1 Jan. 14, 2016

Related U.S. Application Data

(60) Provisional application No. 61/969,131, filed on Mar. 22, 2014.

(51) Int. Cl.

| | |
|---|---|
| ***F41C 33/00*** | (2006.01) |
| ***A45C 3/06*** | (2006.01) |
| ***F41C 33/02*** | (2006.01) |
| ***F41C 33/06*** | (2006.01) |
| ***A45C 3/00*** | (2006.01) |
| ***A45C 11/00*** | (2006.01) |

(52) U.S. Cl.

CPC ..... *A45C 3/06* (2013.01); *A45C 3/001* (2013.01); *A45C 11/00* (2013.01); *F41C 33/0227* (2013.01); *F41C 33/06* (2013.01); *A45F 2200/0591* (2013.01)

(58) Field of Classification Search

CPC ..... F41C 33/00; F41C 33/0209; F45F 2200/0591; A45F 2200/0591

USPC ..... 206/317; 224/911, 914

See application file for complete search history.

(56) References Cited

U.S. PATENT DOCUMENTS

| | | | | | |
|---|---|---|---|---|---|
| 1,828,342 | A * | 10/1931 | Sachs | A45C 3/06 | 150/101 |
| 4,164,308 | A * | 8/1979 | Gautier | A45C 13/18 | 150/109 |
| 4,446,900 | A * | 5/1984 | Markovich | A45C 13/02 | 206/317 |
| 4,933,231 | A * | 6/1990 | Seber | B32B 5/26 | 156/73.1 |
| 5,170,919 | A * | 12/1992 | DeSantis | A45C 1/04 | 224/192 |
| 5,294,031 | A * | 3/1994 | Volpei | A45F 3/00 | 224/192 |
| 5,374,919 | A * | 12/1994 | Zelka | G08B 15/004 | 224/196 |
| 5,505,355 | A * | 4/1996 | Williams | A45C 1/04 | 224/243 |
| 5,662,219 | A * | 9/1997 | Tschudy | F41C 33/06 | 150/113 |
| 7,451,871 | B2 * | 11/2008 | Schuurs | G11B 33/045 | 206/308.1 |

(Continued)

*Primary Examiner* — Sue A Weaver
(74) *Attorney, Agent, or Firm* — James L. Jackson

(57) ABSTRACT

A purse, bag or case having one or more compartments for personal items. A gun storage compartment is defined by wall panels of the purse and has ambidextrous openings with closures for secure access by right or left handed users. A polymer foam panel within the compartment is deformed by a gun to provide a holster-like pocket within which the gun is contained and oriented for ready access and use. A wall panel of the purse is formed by or lined with a ballistic fabric material to resist penetration of the purse by bullets, knives or other objects and provide personal protection for the user.

12 Claims, 4 Drawing Sheets

(56) References Cited

U.S. PATENT DOCUMENTS 8,006,604 B2 * 8/2011 Camp ..... F41C 33/06
206/317

* cited by examiner

CONCEALED CARRY PURSE

RELATED PATENT APPLICATION

Applicant hereby claims the benefit of U.S. Provisional Patent Application No. 61/969,131 of Samantha LaRue Gerdes which was filed on Mar. 22, 2014 and entitled "Purse Having Secure Handgun Pocket Compartment and Projectile Barrier", which application is incorporated by reference herein for all purposes.

BACKGROUND OF THE INVENTION

Field of the Invention

The present invention relates generally to purses that are typically carried by ladies and concerns purses and bags or cases that can be carried by both men and women. More particularly, the present invention concerns the provision of a purse, bag or case having a secure pocket or chamber within which a handgun is positioned for immediate access and use and is secure against unauthorized access by others. This invention also concerns the provision of a projectile resisting wall or barrier that can serve as a defensive shield in the event a bullet, knife or other weapon projectile is directed at the user of the purse, bag or case. More particularly, the present invention also concerns the provision of a yieldable material within the handgun pocket which is readily deformable by the presence of a handgun to define a handgun receptacle that effectively maintains the position and orientation of the handgun within the pocket to suit the needs and desires of the user.

SUMMARY OF THE INVENTION

It is a principal feature of the present invention to provide a novel purse, bag or case, generally referred to herein as a "purse" that has wall or panel structure defining a handgun compartment having zippered openings at opposed sides thereof to facilitate ambidextrous access to a handgun by both left and right handed users.

It is another feature of the present invention to provide a novel purse having a handgun compartment wall that is composed at least partly of a polymer foam material that is readily deformed by a handgun to conform to the size, configuration and orientation of a handgun, thus defining a handgun pocket that maintains a handgun at a desired orientation within the handgun compartment, without any requirement for support straps, snaps or buckles.

It is also a feature of the present invention to provide a novel purse having a wall panel structure that is lined with or composed at least partly of a projectile resistant material to allow the user to position the purse and provide some defensive protection against injury in the event of attack.

Briefly, the various objects and features of the present invention are realized through the provision of a purse having internal and external wall panels and defining one or more internal compartments within which personal items may be stored for efficient access and use. An outer or inner wall panel is provided, which defines a gun storage compartment within which a handgun may be stored for ready access and use in the event personal protection is needed. The gun storage compartment has opposed side openings which allow access to the compartment by both right and left handed users. These side openings have access closures, such as zippers, snaps or the like, which permit the user to rapidly gain access to the gun storage compartment and grasp and withdraw the gun in the event such is needed. Cover strips or flaps are provided externally of the access openings to ensure that the access openings are not readily visible and to provide protection for the zipper or snap closures that are employed. When zippers are used as closures, the zippers will preferably have a locking capability to prevent unauthorized access to the compartment, such as by children.

One wall surface of the gun storage compartment is lined with a readily deformable panel of polymer foam material that is sufficiently soft that it will be easily deformed by the presence of a handgun or other object within the compartment and essentially define a pocket that has the configuration and orientation that is desired by the user of the purse. This feature ensures that the handgun is maintained at a desired position and orientation to provide for efficient access and retrieval of the gun or other object. The opposed wall of the gun storage compartment serves to compress the handgun into the foam material to ensure that the position of the handgun is effectively maintained. Alternatively, a neoprene or other suitable smooth fabric is stretched across the polymer foam material for application of mechanical pressure to a gun within the gun storage compartment and provide a compressive force to cause the gun to be deformed into the polymer foam material and form a gun location pocket within which the gun is retained against shifting movement when the purse is handled by a user. An ammunition cartridge storage receptacle is also provided by the purse structure and may be located within the purse, within the gun storage and access compartment or adjacent to the gun storage and access compartment. The ammunition cartridge storage receptacle is also provided with a secure closure to ensure that access to a cartridge magazine is limited to the user of the purse.

One of the wall panels of the purse, which may be a wall panel of the gun storage compartment, is formed at least in part by a panel of projectile resistant material to provide the user with some protection against injury in the event the user is attacked by a person having a gun, knife or other dangerous object.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an elevation view showing a purse that is constructed according to the principles of the present invention and having a gun storage compartment within which a handgun is intended to be stored for ready access and removal for self-protection;

FIG. 2 is a section view taken through the gun storage compartment and showing the use of polymer foam or similar material that is capable of forming a gun pocket conforming to the configuration and orientation of a handgun within the compartment;

FIG. 3 is a fragmentary section view of the purse, showing lining of the inner surface of a wall panel by a panel of projectile resistant ballistic fabric material such as Kevlar® and showing a gun within the gun storage compartment which is located within a holster-like gun pocket that has been deformed into polymer foam material within the gun storage compartment;

FIG. 4 is a front elevation view showing a concealed carry purse that is constructed according to the principles of this invention and employs a gun storage and access compartment having ambidextrous zippered closures each having closure lips or flaps for enhanced compartment concealment;

FIG. 5 is also a front elevation view showing an alternative embodiment of the concealed carry purse, having a gun storage and access compartment having a single top access opening that is provided with a zipper type closure for it access opening;

FIG. 6 is another front elevation view showing an embodiment of the present invention wherein a concealed carry compartment is defined in part by the front wall of the purse and has side access openings that are substantially concealed by folds of the material from which the purse is composed;

Figure 7:
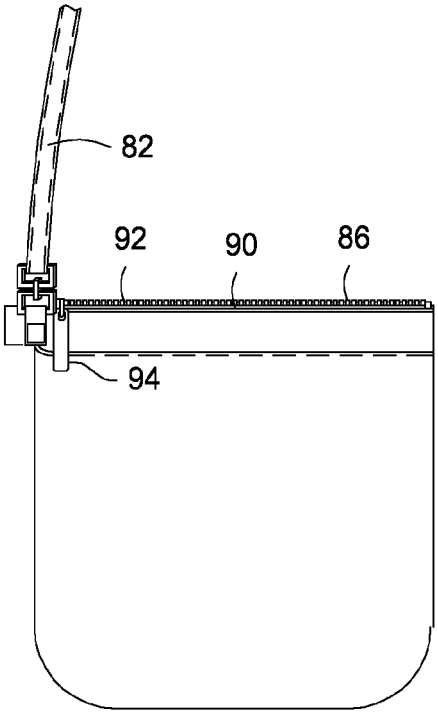
Figure 8:
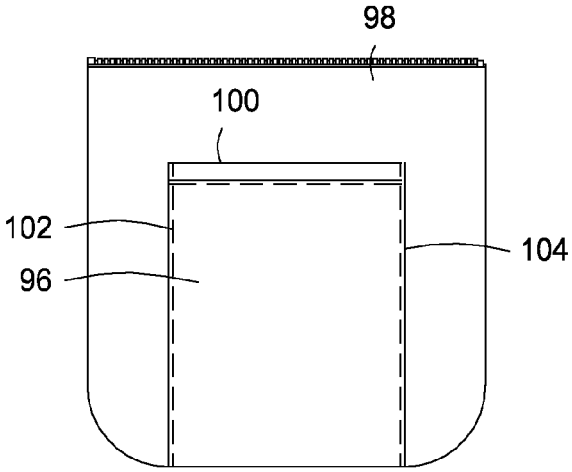

FIG. 7 is a front elevation view showing a concealed carry purse according to the present invention which is designed to be supported by a shoulder strap and which employs a top opening of a gun storage and access compartment that has a zipper type closure; and FIG. 8 is another elevation view showing a concealed carry purse of similar design as shown in FIG. 7 and which has a front wall portion defining a gun storage and access compartment with side access openings.

DETAILED DESCRIPTION OF PREFERRED EMBODIMENT

Figure 1:
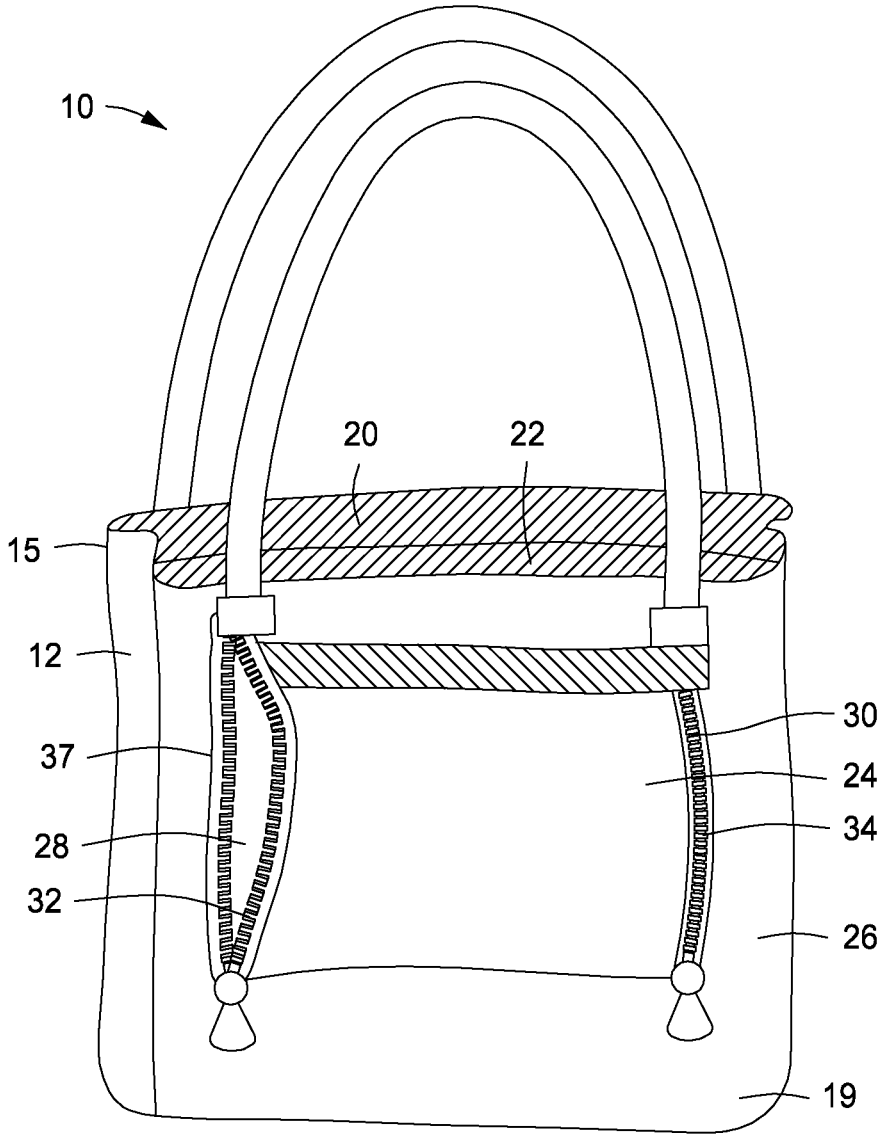

Referring now to the drawings and first to FIG. 1, a purse embodying the principles of the present invention is shown generally at 10 and has front and rear panels forming a main compartment 12. One or more handles 14 are attached to the front and rear panels 13 and 15 to permit ease of manually carrying the purse. The main compartment 12 may have any desired number of internal partitions defining one or more storage compartments and pockets to facilitate the storage and access of personal items such as make-up, cellular telephones, money and credit or debit card compartments and the like. At least one wall 16 of the main compartment 12 is formed by or lined with a panel 18 of projectile resistant ballistic fabric material, such as Kevlar®, that resists complete penetration of the purse by an ammunition projectile or by a knife or other sharp pointed instrument and serves to provide some protection of the user of the purse from injury in the event of an attack where guns, knives and other weapons are used by assailants.

The purse has an upper access opening 20 that may be provided with a zipper or snap closure to permit the user to access various personal items that are maintained within the various compartments within the purse. The purse has an outer wall panel 22, providing an outer pouch or compartment for magazines, papers and other large objects that can be accessed without necessitating opening of the main compartment of the purse.

Figure 3:
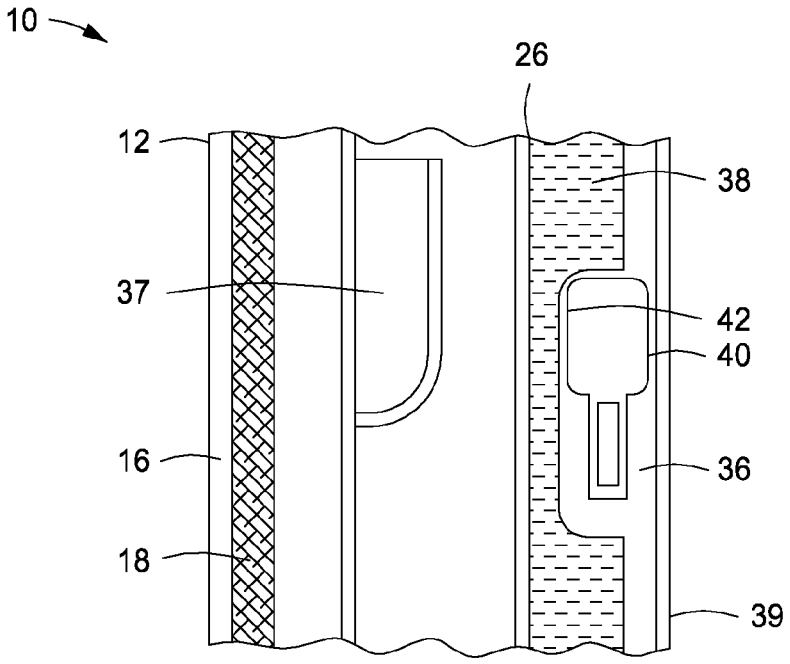

An outer gun compartment wall panel 24 is mounted, such as by stitching or any other suitable means for attachment, to a wall panel 26 of the main compartment 12. The wall panel 26 may be a front wall panel, as shown in FIG. 1, or a rear wall panel so that a gun storage compartment can be located on the front or rear of the main compartment as desired by the user. The outer gun compartment wall panel 24 is secured to end opening panels 28 and 30 that are in turn secured to an outer wall panel 26 of the main compartment 12. Each of the end opening panels is preferably provided with a zipper closure 32 and 34 so that the gun storage compartment 36 can be easily and quickly accessed from either side of the purse, such as by the right hand or left hand of the user. An ammunition receptacle 37, shown in FIGS. 1 and 3, is mounted to or adjacent to the gun storage and access compartment 36 or may be located within the purse or within the gun storage and access compartment for easy access as needed. The zipper closures 32 and 34 are preferably of the locking variety so that the gun storage compartment can be locked when appropriate and thus secure from unauthorized access by anyone, particularly children, especially when the purse is left unattended for any period of time.

Figure 2:
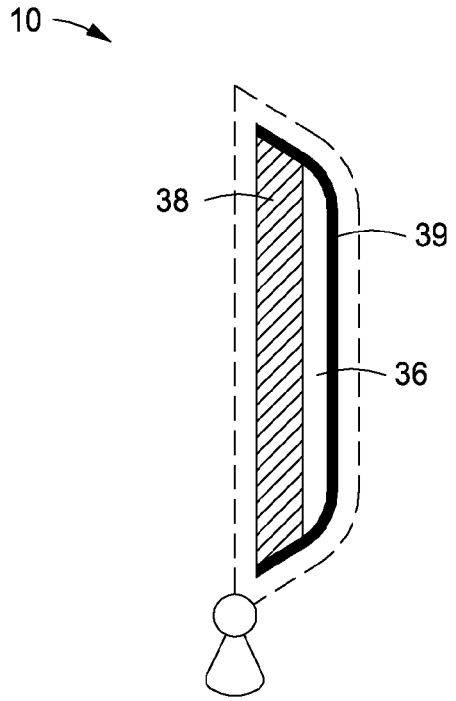

With reference to FIGS. 2 and 3 the main compartment structure 12 of the purse 10, the section views show a panel 38 of soft and readily deformable material, such as polymer foam, sponge rubber or the like, having a thickness from about one-half inch to about 1 inch. The panel 38 is preferably mounted to an internal wall surface of the gun storage and access compartment, which may be defined by the outer wall panel 26 of the purse. Alternatively, the panel 38 of polymer foam material may be of a size and configuration to substantially completely fill the gun storage and access compartment, thus preventing the panel from shifting as the purse is used. A neoprene or other suitable smooth fabric is stretched across the polymer foam material for application of mechanical pressure to a gun within the gun storage and access compartment providing a compressive force to cause the gun to be deformed into the polymer foam material and form a gun location and orientation pocket within which the gun is retained against shifting movement when the purse is handled by a user. A handgun can be positioned within the storage and access compartment at a desired orientation to facilitate ease of grasping and withdrawal for efficient use. The gun location and orientation pocket will then be deformed by the pressure or force of the gun, so that the pocket will have the location and orientation that is desired by the user. FIG. 3 and shows a handgun 40 being located within the gun storage compartment 36 and having deformed the polymer foam or other soft and deformable material to form a holster-like pocket 42 within the polymer foam material due to the compression effect of the smooth fabric material and the compartment wall 24. The deformed pocket essentially conforms to the size and configuration of the handgun and is oriented according to the desires of the user so that the user can easily reach into the gun storage compartment and grasp the handle or any other desired portion of the handgun and withdraw it from the compartment for use. The deformed pocket also prevents the handgun from shifting its position within the gun storage compartment as the purse is handled by the user during normal use. And of course the bulk and weight of a holster or handgun container is avoided, making the purse easier to carry and use.

The various panels of the purse may be composed of leather, polymer panel material, canvass or any other material that is conventionally employed for the manufacture of purses bags and other cases for use by both men and women.

Figure 4:
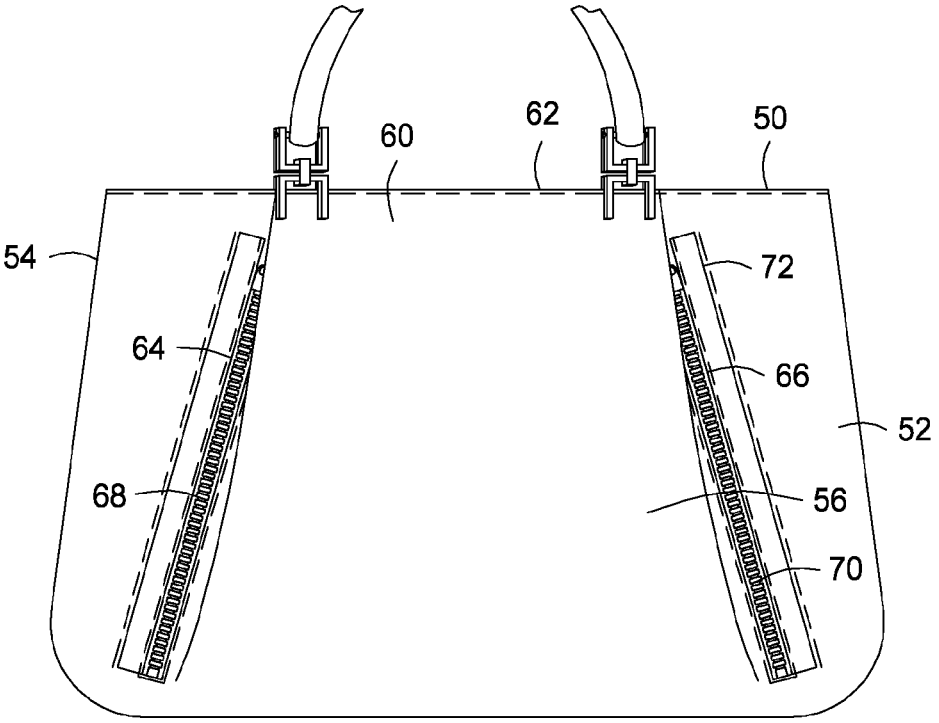

Referring now to FIGS. 4-8, several embodiments of the concealed carry purse of the present invention are shown. Each embodiment has in common the provision of a handgun storage and access compartment having one or more access openings that are oriented to facilitate ready compartment access by a hand of the user to facilitate grasping and withdrawal of a handgun as necessary. In FIG. 4 the concealed carry purse 50 has front and rear purse panels 52 and 54 that form the basic purse structure, with any desired number of internal compartment being typically provide to suit the needs of most purse users. A compartment panel 56 is mounted to or extends from the front purse panel 52. In this case, the compartment panel 56 is of upwardly converging tapered configuration to define a pleasing purse appearance. One or more handles 58 are mounted to the upper extent 60 of the purse structure to facilitate ease of carrying. The upper extent 60 also defined a large upwardly facing opening that may be conveniently closed by means of a zipper or snaps.

The compartment panel 56 cooperates with the front wall panel structure 52 of the purse to define a handgun storage and access compartment within which a handgun may be stored for ready access. A pair of outwardly facing compartment access openings 64 and 66 are each provided with zipper type locking closures 68 and 70. Zipper cover strips or flaps 72 extend from the compartment panel 56 as shown in broken line in FIG. 4 and serve to provide weather and dust protection for the zipper closures and ensure that the presence of the access openings and zipper closures is not readily apparent. The handgun storage and access compartment contains a panel of soft readily deformable material such as polymer foam as discussed above in connection with FIGS. 1-3 and a panel of projectile resistant material is incorporated with the purse structure as also discussed.

Figure 5:
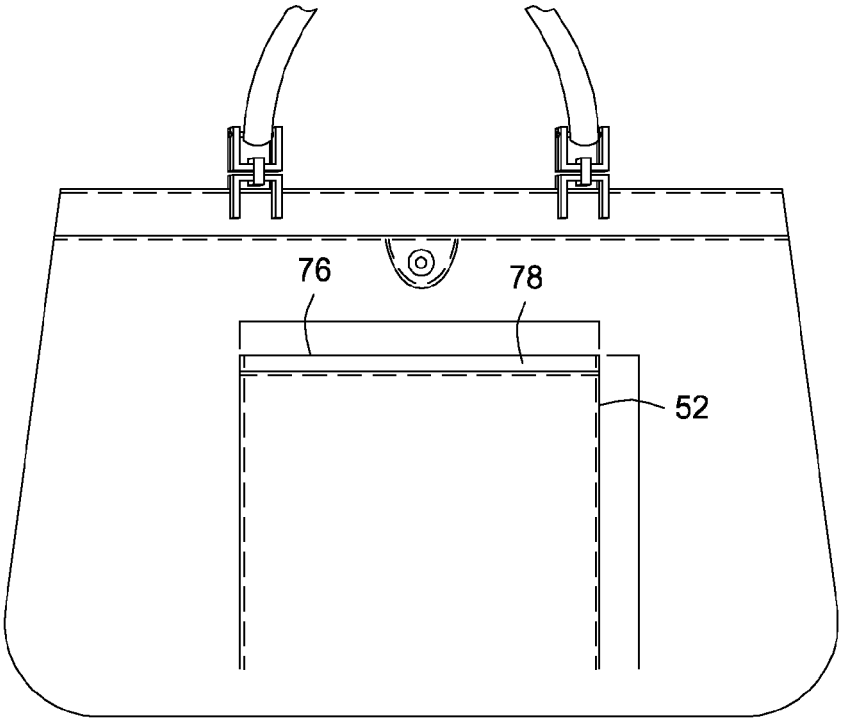

The concealed carry purse of FIG. 5 differs from the structure of FIG. 4 only in that the handgun storage and access compartment 74 is smaller in size and defines an upwardly facing access opening 76 that is provided with a lockable zipper closure 78. The handgun storage and access compartment 74 is provided with an internal panel of readily deformable material such as polymer foam and has a projectile resistant panel mounted within the purse structure and having a dimension almost equal to the dimension of the purse.

Figure 6:
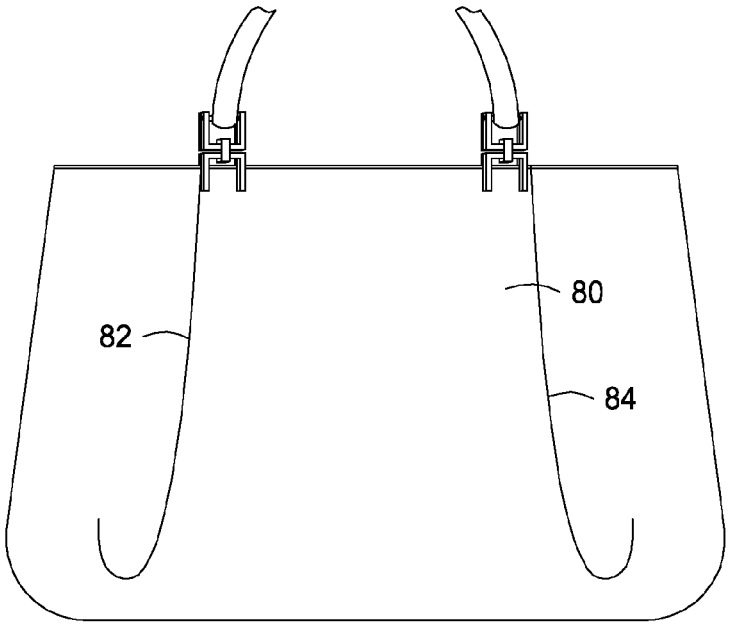

The concealed carry purse of FIG. 6 differs from the purse structure of FIG. 4 only is the provision of a decorate compartment panel 80 having gently curved sides 82 and 84 that are decoratively pleasing and also provide lateral closures for ambidextrous side access openings that have zipper type closures. A polymer foam panel within the handgun storage and access compartment serves to maintain a handgun securely positioned and stabilized within the compartment for ready access by a user.

A concealed carry purse 86 is shown in FIG. 7 that is designed with an adjustable strap 88 for over the shoulder or cross-body carrying capability. The purse of FIG. 7 is manufactured with a handgun storage and access compartment having a upwardly facing access opening 90 having a zipper closure 92 with a zipper pull tab 94 by with the user of the purse can achieve efficient opening of the zipper.

The concealed carry purse 96 of FIG. 8 is basically designed to be carried by an over the shoulder or cross-body strap as shown in FIG. 7 and has a compartment panel 96 that is stitched or otherwise secured to the front panel 98. The basic purse structure has an upwardly facing opening for use by the user. The compartment panel 96 can be provided with an upwardly facing compartment access opening at 100 or may be provided with one or more side access openings 102 and 104 to facilitate ambidextrous access to the compartment and a handgun or other object therein. Here again, the gun storage and access compartment has a polymer foam panel and a projectile resistant panel for the purposes that have been discussed above.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A concealed carry purse, comprising: inner and outer purse wall panels defining a main storage and access compartment for handguns or other objects said inner wall panel defining an internal surface;

a panel of projectile and puncture resistant material being mounted to said internal surface of said inner wall panel and being resistant to penetration by projectiles such as bullets and sharp pointed objects such as knives, said panel of projectile and puncture resistant material and said outer purse wall panel defining said main storage and access compartment;

an access opening being defined for said main storage and access compartment and having a closure member;

an outer gun compartment panel being mounted to said outer purse wall panel and defining a gun storage and access compartment and having ambidextrous openings permitting right handed and left handed access of a user to said gun storage and access compartment; and a panel of soft deformable polymer foam material being located within said gun storage and access compartment and being readily deformed by a handgun or other object within said gun storage and access compartment to define a form fitting location and stabilization pocket within which the handgun or other object is selectively oriented and maintained for ready access by the user of the purse.

2. The concealed carry purse of claim 1, comprising:

a panel of smooth fabric material being mounted within said gun storage and access compartment in juxtaposition with said panel of polymer foam material and substantially continuously applying force to the handgun or other object to depress the handgun or other object into the panel of polymer foam material displacing said polymer foam material and causing said handgun or other object to form said form fitting location and stabilization pocket within said panel of polymer foam material.

3. The concealed carry purse of claim 1, comprising:

said gun storage and access compartment being defined in part by a purse wall having an internal wall surface;

said panel of soft deformable polymer material being a body of polymer foam mounted to said internal wall surface and having a thickness of from about one-half inch to about 1 inch; and a panel of smooth fabric material being mounted within said storage and access compartment in juxtaposition with said panel of soft polymer foam material and substantially continuously applying force to the handgun or other object to depress the handgun or other object into the panel of soft polymer foam material.

4. The concealed carry purse of claim 1, comprising:

a pair of side access openings being defined for said storage and access compartment and being arranged for right hand and left hand access by a user; and secure locking zipper closure members being located at each of said pair of access openings and selectively closing and securing said side access openings until access to said handgun or other object is desired.

5. The concealed carry purse of claim 4, comprising:

protective flap members extending from said purse and being positioned to cover and substantially obscure said locking zipper closure members from view.

6. A concealed carry purse, comprising:

inner and outer purse wall panels defining the external walls of a purse having a main storage compartment and defining a main access opening and having a plurality of internal compartments within said main storage compartment for personal objects;

a panel of projectile and puncture resistant material being located within said main storage compartment;

an access opening being defined for said main storage and access compartment and having a closure member;

an outer gun compartment panel being mounted to said outer purse wall panel and defining a gun storage and access compartment and defining a pair of side access openings permitting selective access to said gun storage and access compartment by the right hand or left hand of a user;

closure members being located at said pair of side access openings and permitting selective access to said gun storage and access compartment; and a panel of soft deformable polymer foam material being mounted to said outer gun compartment panel and located within said gun storage and access compartment and being readily deformed by compression of a handgun within said storage and access compartment to define a form fitting stabilization and access pocket in said deformable polymer foam material within which a handgun is oriented and maintained for ready access by the user of the purse through either of said pair of side access openings.

7. The concealed carry purse of claim 6, comprising:

said gun storage and access compartment being defined in part by a purse wall having an internal wall surface; and said panel of soft deformable material being a body of polymer foam material mounted to said internal wall surface and having a thickness of from about one-half inch to about 1 inch, said panel of polymer foam material being readily deformed by the force of a handgun to define said location and stabilization pocket within which the handgun is secured and stabilized at an orientation that is selected by the user of said concealed carry purse.

8. The concealed carry purse of claim 6, comprising:

said gun storage and access compartment being defined in part by a purse wall having an internal wall surface;

said panel of soft deformable material being a body of polymer foam material mounted to said internal wall surface and having a thickness of from about one-half inch to about 1 inch; and a panel of smooth fabric material being mounted within said gun storage and access compartment in juxtaposition with said panel of polymer foam material and substantially continuously applying force to the handgun to depress the handgun into the polymer foam material and form said location and stabilization pocket.

9. The concealed carry purse of claim 6, comprising:

said pair of side access openings being selectively arranged for right hand and left hand access by a user; and secure closure members being located at each of said pair of side access openings and permitting selective closing and securing of said side access openings by the user and prohibiting unauthorized access to said gun storage and access compartment.

10. The concealed carry purse of claim 9, comprising:

said secure closure members being zipper type closures having locking capability; and protective flap members extending from said purse and being positioned to cover and substantially obscure said zipper type closures from view.

11. The concealed carry purse of claim 6, comprising:

an ammunition magazine receptacle being mounted to said purse adjacent said gun storage and access compartment and having a lockable closure for safely securing an ammunition magazine therein.

12. The concealed carry purse of claim 6, comprising:

an ammunition magazine receptacle being mounted to said purse within said gun storage and access compartment for securing an ammunition magazine in position for ease of access.

* * * * *